US012662344B2

(12) United States Patent
Lee et al.

(10) Patent No.: US 12,662,344 B2
(45) Date of Patent: Jun. 23, 2026

(54) POUCH ROLL REPLACEMENT SYSTEM

(71) Applicant: LG Energy Solution, Ltd., Seoul (KR)

(72) Inventors: Seung Bae Lee, Daejeon (KR); Duk Keun Oh, Daejeon (KR); Jin Soo Lee, Daejeon (KR); Ju Hwan Baek, Daejeon (KR); Seok In Hong, Daejeon (KR)

(73) Assignee: LG Energy Solution, Ltd., Seoul (KR)

( * ) Notice: Subject to any disclaimer, the term of this patent is extended or adjusted under 35 U.S.C. 154(b) by 108 days.

(21) Appl. No.: 18/712,447

(22) PCT Filed: Jun. 14, 2023

(86) PCT No.: PCT/KR2023/008156
§ 371 (c)(1),
(2) Date: May 22, 2024

(87) PCT Pub. No.: WO2023/243999
PCT Pub. Date: Dec. 21, 2023

(65) Prior Publication Data

US 2025/0011119 A1 Jan. 9, 2025

(30) Foreign Application Priority Data

Jun. 14, 2022 (KR) ..... 10-2022-0072001

(51) Int. Cl.
*B65H 19/12* (2006.01)

(52) U.S. Cl.
CPC ..... *B65H 19/126* (2013.01); *B65H 2408/24* (2013.01); *B65H 2557/63* (2013.01)

(58) Field of Classification Search
CPC ..... B65H 19/00; B65H 19/10; B65H 19/105; B65H 19/30; B65H 2557/63;
(Continued)

(56) References Cited

U.S. PATENT DOCUMENTS 2,535,815 A * 12/1950 Seeger ..... B65H 19/126 242/559.1
4,183,710 A * 1/1980 Burdick ..... B60V 3/025 414/458
(Continued)

FOREIGN PATENT DOCUMENTS

CN 112713298 A * 4/2021 ..... B65H 19/1873
CN 114056981 A * 2/2022 ..... B65H 19/102
(Continued)

OTHER PUBLICATIONS

International Search Report for PCT/KR2023/008156 mailed Sep. 22, 2023. 3 pages.
(Continued)

*Primary Examiner* — Emmanuel M Marcelo
*Assistant Examiner* — Ermia E. Melika
(74) *Attorney, Agent, or Firm* — Lerner David LLP

(57) ABSTRACT

A pouch roll replacement system comprises a transport part, a replacement chucking part, an unwinder chucking part, a measuring part, and a control part. The transport part transports a replacement pouch roll and is capable of adjusting the central axis height of the replacement pouch roll The replacement chucking part is provided to chuck the replacement pouch roll transported through the transport part and has a predetermined chucking height The unwinder chucking part accommodates a traveling pouch roll and the measuring part measures the distance to the replacement pouch roll seated on the transport part before transporting the replacement pouch roll to the replacement chucking part. The control part controls the transport part so that the central axis height of the replacement pouch roll seated on the transport part is adjusted based on the measurement information of the measuring part and the chucking height of the replacement chucking part.

20 Claims, 4 Drawing Sheets

(58) Field of Classification Search
CPC .... B65H 2301/4182; B65H 2301/4185; B65H 2301/413526; H01M 10/0404; H01M 50/105
USPC ..... 242/558, 559.4
See application file for complete search history.

(56) References Cited

U.S. PATENT DOCUMENTS 4,948,060 A * 8/1990 Kurz ..... B65H 19/105 242/559.2
5,192,033 A * 3/1993 Pipes ..... B65H 19/126 242/559.1
5,833,167 A * 11/1998 Thuer ..... B65H 19/12 414/749.3
5,934,604 A * 8/1999 Klimek ..... B65H 19/126 242/558
6,176,670 B1 * 1/2001 Salsburg ..... B21C 47/24 242/563
6,260,783 B1 * 7/2001 Realff ..... B65H 67/063 294/98.1
6,355,139 B1 * 3/2002 Baggot ..... B65H 16/103 242/545.1
6,402,083 B1 * 6/2002 Horn ..... B65H 19/123 242/561
6,440,268 B1 * 8/2002 Baggot ..... B65H 16/10 162/120
8,322,646 B2 * 12/2012 Ueyama ..... B65H 19/223 242/559.4
8,770,508 B2 * 7/2014 Tenpaku ..... B65H 19/126 242/559.4
8,919,686 B2 * 12/2014 Tenpaku ..... B65H 19/126 242/559.4
2009/0116948 A1 * 5/2009 Keller ..... B65H 19/12 414/754
2009/0294570 A1 * 12/2009 Wenk ..... B65H 19/126 242/615.3
2012/0048986 A1 * 3/2012 Enwald ..... B65H 19/126 242/598.5
2012/0236141 A1 * 9/2012 Takagawa ..... B65H 75/425 348/95
2014/0326822 A1 * 11/2014 Morelli ..... B65H 16/106 242/555.3
2015/0005929 A1 * 1/2015 Adachi ..... B65H 20/24 700/230
2017/0152120 A1 * 6/2017 Montoya ..... B65H 23/0326
2020/0156813 A1 * 5/2020 Wipf ..... B25J 15/0047
2020/0370219 A1 * 11/2020 Myers ..... D05B 11/00
2021/0245983 A1 * 8/2021 Paolinelli ..... B65H 19/126
2021/0292120 A1 * 9/2021 Li ..... B65H 19/1847
2022/0001634 A1 * 1/2022 Dettorre ..... B29D 30/0016
2023/0150784 A1 5/2023 Lee et al.

FOREIGN PATENT DOCUMENTS

EP 1647508 A1 4/2006
JP H0466140 U 6/1992
JP H0568808 U 9/1993
JP 2011079602 A 4/2011
JP 2014105048 A 6/2014
KR 20160133264 A 11/2016
KR 101956930 B1 3/2019
KR 20200066018 A 6/2020
KR 102171461 B1 * 10/2020 ..... B65H 19/126
KR 102171473 B1 * 10/2020 ..... B65H 19/126
KR 20210029448 A 3/2021
KR 102325380 B1 * 11/2021 ..... B65H 19/123
KR 102335410 B1 * 12/2021 ..... B65H 19/126
KR 20220008631 A 1/2022
KR 20220071348 A 5/2022
WO WO-2021096068 A1 * 5/2021 ..... B65H 21/00

OTHER PUBLICATIONS

Extended European Search Report for Application No. 23824213.5 dated Mar. 19, 2025, pp. 1-7.

* cited by examiner

[Figure 1]
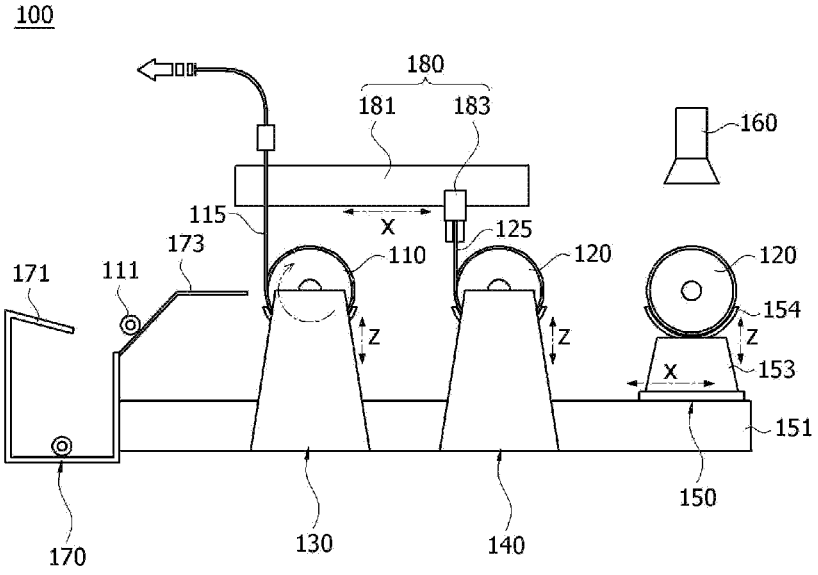
[Figure 2]
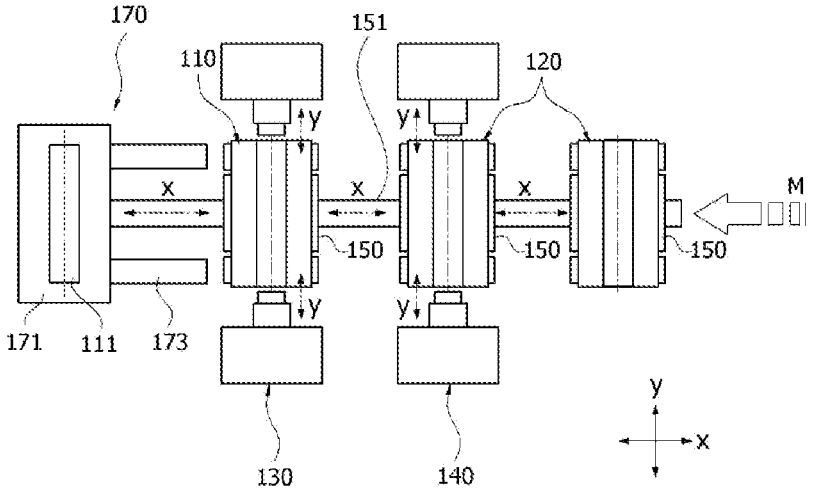

[Figure 3]
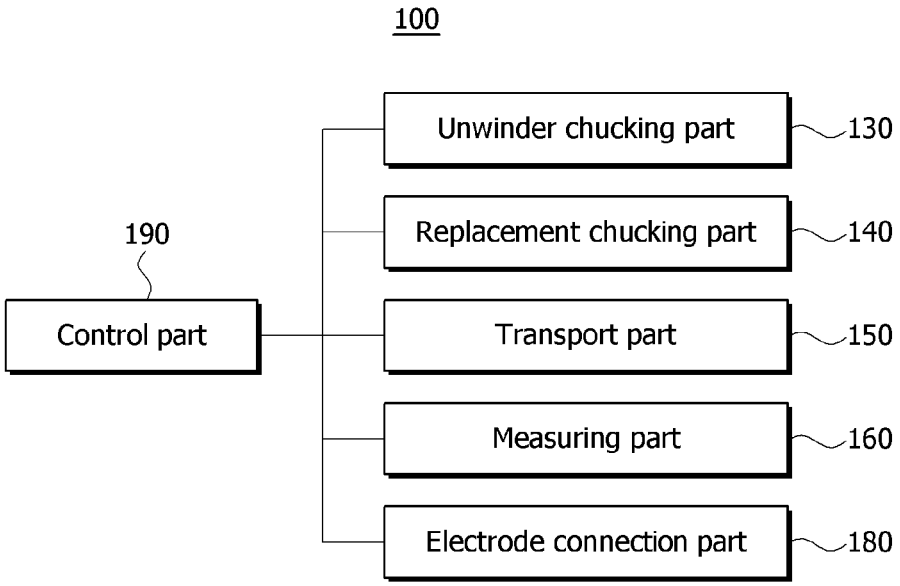
[Figure 4]
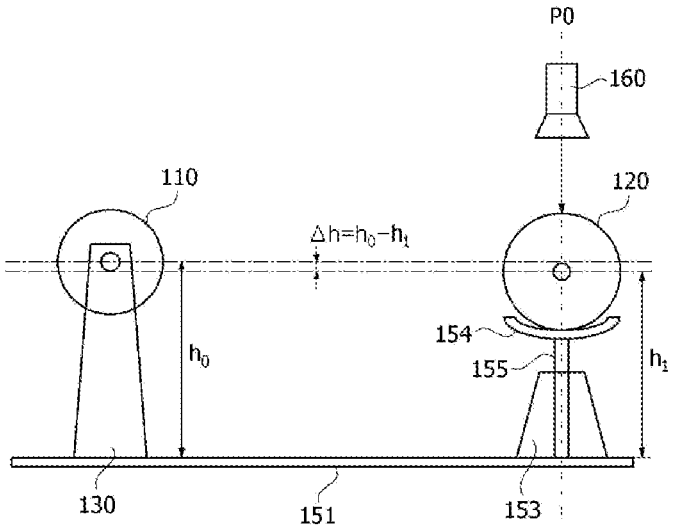

[Figure 5]
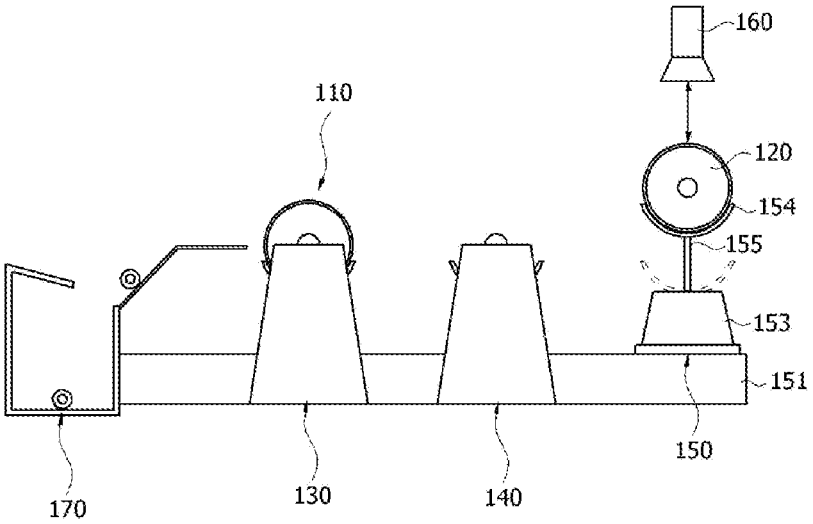
[Figure 6]
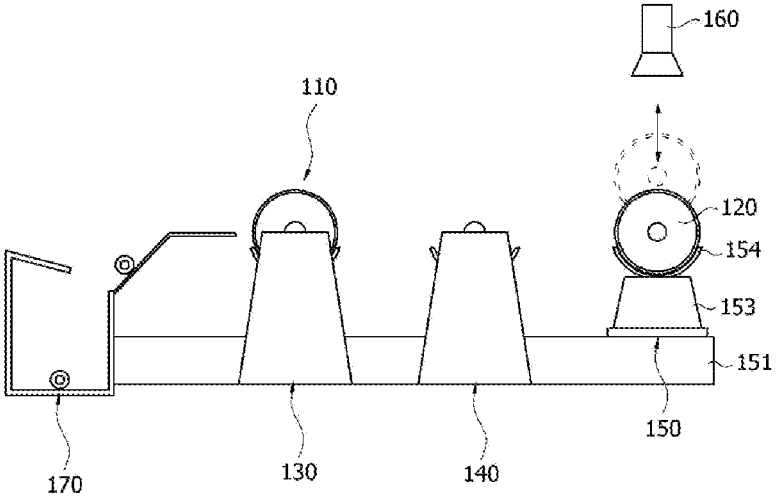

[Figure 7]
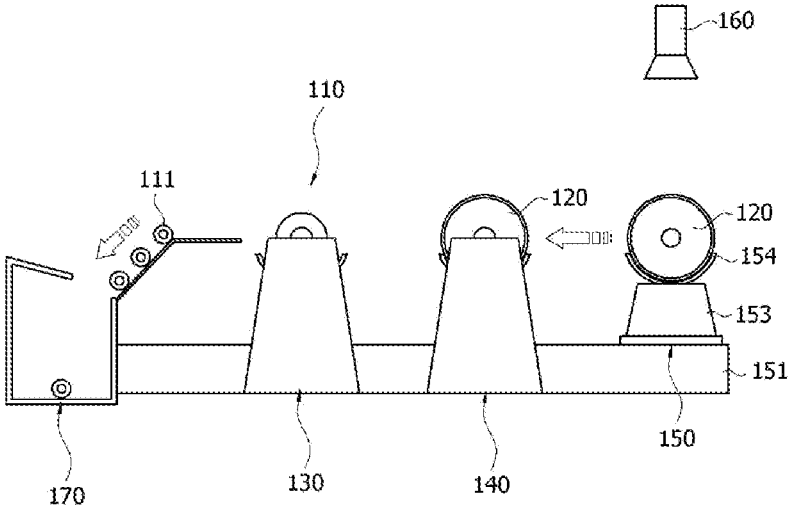
[Figure 8]
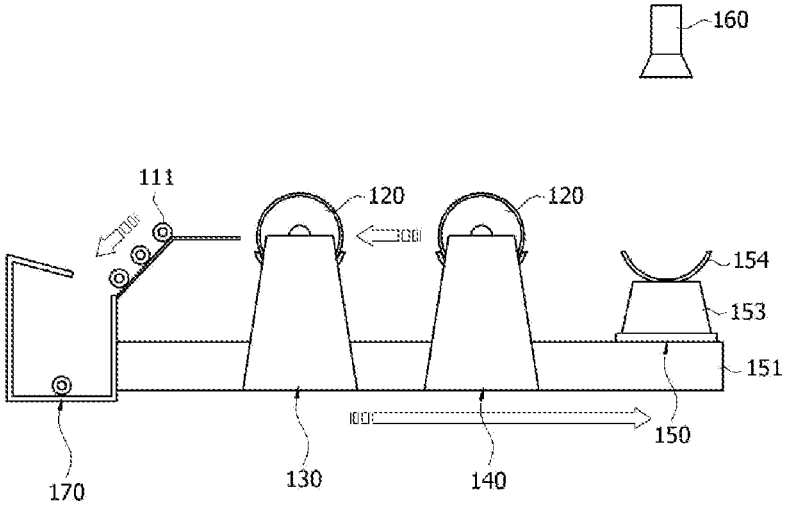

POUCH ROLL REPLACEMENT SYSTEM

CROSS-REFERENCE TO RELATED APPLICATIONS

The present application is a national phase entry under 35 U.S.C. § 371 of International Application No. PCT/KR2023/008156, filed on Jun. 14, 2023, which claims priority from Korean Patent Application No. 10-2022-0072001, filed on Jun. 14, 2022, all of which are incorporated herein by reference.

TECHNICAL FIELD

The present disclosure relates to a pouch roll replacement system and a pouch roll position correction method using the same, and specifically, relates to a pouch roll replacement system capable of matching a central axis height of a replacement pouch roll before transport to chucking heights of a replacement chucking part and an unwinder chucking part, and a pouch roll position correction method thereof.

BACKGROUND ART

Lithium secondary batteries, which can be charged and discharged, are also used as an energy source for electric vehicles, hybrid electric vehicles, and the like, which are presented as an alternative to existing gasoline and diesel vehicles that cause air pollution.

In the lithium secondary batteries, a positive electrode and a negative electrode are laminated with a separator interposed therebetween, where charging and discharging can be repeatedly performed while lithium ions move between the positive electrode and the negative electrode.

In the case of a pouch-type secondary battery, after manufacturing an electrode assembly in which positive electrodes, separators, and negative electrodes are cross-laminated, the electrode assembly is accommodated in a pouch. That is, the pouch is used as a case that forms the exterior of the secondary battery.

In a secondary battery manufacturing process, the pouch is supplied in a roll-to-roll manner. However, when the entire pouch roll wound in the form of a roll is used up, a worker stops the equipment, connects the end of the pouch wound around the pouch roll during use to the end of the pouch wound around a new pouch roll with a tape, and then restarts the equipment.

While the pouch roll is chucked to an unwinder, and the pouch wound around the pouch roll is unwound by the unwinder, the pouch is supplied to the battery manufacturing process.

Meanwhile, when the roll diameter of the replacement pouch roll supplied to the unwinder varies, the chucking height of the pouch roll may vary, where conventionally, a worker has manually adjusted the standby height of the replacement pouch roll up to the chucking height.

In general, pouch rolls are difficult to transport as they weigh approximately 200 kg or more, and there is a risk that safety accidents occur when the pouch roll falls.

In addition, conventionally, upon pouch roll replacement, the equipment had to be shut down, and there was a problem that the workload of the worker was caused due to frequent replacement.

DISCLOSURE

Technical Problem

An aspect of the present invention is intended to provide a pouch roll replacement system capable of adjusting a chucking height of a replacement pouch roll according to the diameter of the replacement pouch roll, and a pouch roll position correction method using the same.

In addition, an aspect of the present invention is intended to provide a pouch roll replacement system capable of adjusting a central axis height of a replacement pouch roll before transport to chucking heights of a replacement chucking part and an unwinder chucking part, even if the roll diameter is different for each replacement pouch roll, and a pouch roll position correction method using the same.

Technical Solution

In order to solve the above problem, a pouch roll replacement system according to one example of the present invention comprises a transport part transporting a replacement pouch roll and capable of adjusting the central axis height of the replacement pouch roll, a replacement chucking part provided to chuck the replacement pouch roll transported through the transport part and having a predetermined chucking height, an unwinder chucking part with a traveling pouch roll installed, a measuring part measuring the distance to the replacement pouch roll seated on the transport part before transporting the replacement pouch roll to the replacement chucking part, and a control part controlling the transport part so that the central axis height of the replacement pouch roll seated on the transport part is adjusted based on the measurement information of the measuring part and the chucking height of the replacement chucking part.

Also, the control part may be provided to control the operation of the transport part so that the replacement pouch roll is transported to the replacement chucking part after adjusting the central axis height of the replacement pouch roll seated on the transport part.

In addition, the control part may be provided so that it calculates the diameter of the replacement pouch roll based on the measurement information, and calculates the difference between the chucking height of the replacement chucking part and the center axis height of the replacement pouch roll seated on the transport part based on the diameter of the replacement pouch roll.

Furthermore, the control part may calculate the difference between the chucking height of the replacement chucking part and the central axis height of the replacement pouch roll seated on the transport part as a height correction value, and may control the transport part so that the central axis height of the replacement pouch roll seated on the transport part is adjusted by the height correction value.

Also, the control part may adjust the central axis height of the replacement pouch roll seated on the transport part so that the central axis height of the replacement pouch roll seated on the transport part matches the chucking height of the replacement chucking part.

In addition, the unwinder chucking part may have the same chucking height as that of the replacement chucking part, and the transport part may be provided to transport the replacement pouch roll from the replacement chucking part to the unwinder chucking part.

Furthermore, the transport part may comprise a transport rail extending to guide the transport of the replacement pouch roll through the replacement chucking part to the unwinder chucking part, a shuttle including a seating member, on which the replacement pouch roll is seated, and provided to be movable along the transport rail, and a height adjustment unit adjusting the height of the seating member.

Also, the shuttle may be provided to be capable of reciprocating along the transport rail. In addition, the shuttle may be provided so that when the traveling pouch roll is replaced with the replacement pouch roll, it is moved to the unwinder chucking part, and after the replacement pouch roll is chucked to the unwinder chucking part, it moves from the unwinder chucking part to the measuring part.

Furthermore, the seating member may be curved to a predetermined curvature.

Also, the measuring part may comprise a distance sensor measuring the distance from the replacement pouch roll seated on the transport part.

In addition, the distance sensor may be an ultrasonic sensor.

Furthermore, the pouch roll replacement system may further comprise a pouch connection part gripping the end of the pouch wound around the replacement pouch roll chucked to the replacement chucking part, and then transferring the end of the pouch toward the unwinder chucking part.

Also, the pouch connection part may comprise a guide bar extending from the upper part of the replacement chucking part to the upper part of the unwinder chucking part, and a gripper installed to be movable along the guide bar and holding the end of the pouch wound around the replacement pouch roll to move from the replacement chucking part toward the unwinder chucking part.

In addition, when the end of the pouch is gripped through the pouch connection part, the control part may chuck-release the replacement pouch roll from the replacement chucking part, and then transport the replacement pouch roll to the unwinder chucking part through the transport part.

Furthermore, the pouch roll replacement system may further comprise a roll core recovery part recovering the roll core of the traveling pouch roll chuck-released from the unwinder chucking part.

Advantageous Effects

As discussed above, the pouch roll replacement system according to one example of the present invention, and the pouch roll position correction method using the same have the following effects.

By measuring the roll diameter of the replacement pouch roll seated on the transport part, it is possible to adjust the central axis height of the replacement pouch roll seated on the transport part to the chucking heights of the replacement chucking part and the unwinder chucking part before transporting the replacement pouch to the replacement chucking part.

Also, it is possible to automatically correct the position (height) of the replacement pouch roll seated on the transport part so that the central axis height of the replacement pouch roll matches the chucking height of the traveling pouch roll.

In addition, even if the roll diameter is different for each replacement pouch roll, the roll diameter is measured for each replacement pouch roll seated on the transport part, and thus, the height of the replacement pouch roll is automatically corrected so that the central axis height of the replacement pouch roll matches the central axis height of the traveling pouch roll, whereby it is possible to automatically supply the replacement pouch roll to the replacement chucking part and the unwinder chucking part.

DESCRIPTION OF DRAWINGS

FIG. 1 schematically illustrates a side arrangement diagram of a pouch roll replacement system according to one example of the present invention.

FIG. 2 schematically illustrates a plan arrangement diagram of a pouch roll replacement system according to one example of the present invention.

FIG. 3 schematically illustrates a configuration diagram of a pouch roll replacement system according to one example of the present invention.

FIG. 4 is a diagram for explaining a process for correcting a height of a replacement pouch roll in one example of the present invention.

FIGS. 5 to 8 are diagrams for explaining operating states of a transport part in a pouch roll replacement system according to one example of the present invention.

DETAILED DESCRIPTION

Hereinafter, a pouch roll replacement system according to one example of the present invention, and a pouch roll position correction method using the same will be described in detail with reference to the drawings.

In addition, regardless of the reference numerals, the same or corresponding components are given by the same or similar reference numerals, duplicate descriptions thereof will be omitted, and for convenience of explanation, the size and shape of each component member as shown can be exaggerated or reduced.

FIG. 1 schematically illustrates a side arrangement diagram of a pouch roll replacement system according to one example of the present invention, and FIG. 2 schematically illustrates a plan arrangement diagram of a pouch roll replacement system according to one example of the present invention.

The pouch roll replacement system (100) related to one example of the present invention comprises an unwinder chucking part (130), a replacement chucking part (140), a transport part (150), a measuring part (160), and a control part (190).

Referring to FIGS. 1 and 2, the transport part (150) is provided to transport a replacement pouch roll (120) along a transport direction (M, x-axis direction in FIG. 1). The transport part (150) transports the replacement pouch roll (120) to the replacement chucking part (140). In addition, when chucking and chuck-release are performed in the replacement chucking part (140), the transport part (150) transports the chuck-released replacement pouch roll (120) to the unwinder chucking part (130).

Referring to FIG. 2, the y-axis direction represents the chucking and chuck-release direction performed in the chucking parts (130, 140), and the y-axis direction may be orthogonal to the transport direction (M).

The unwinder chucking part (130) chucks a traveling pouch roll and a replacement pouch roll and unwinds the pouch wound around the chucked pouch roll, thereby performing a function of supplying pouches to the battery manufacturing process.

In this document, the 'traveling pouch roll (110)' means a pouch roll chucked to the unwinder chucking part (130) to supply a pouch (115) to the battery manufacturing process. In addition, the 'replacement pouch roll (120)' means a pouch roll newly chucked to the unwinder chucking part (130) when the use of the traveling pouch roll (110) chucked to the unwinder chucking part (130) is completed.

Also, the traveling pouch roll (110) and the replacement pouch roll (120) comprise roll cores and pouches (115, 125) wound around the roll cores, respectively, where each pouch roll (110, 120) may have a cylindrical shape. At this instance, the roll core has a central axis, and the central axes of the traveling and replacement pouch rolls (110, 120) are chucked to the respective chucking parts (130, 140). At this time, each chucking part (130, 140) has a predetermined chucking height, where the chucking height may be a height (z-axis direction in FIG. 1) based on the bottom surface of the installation space on which the chucking part is installed.

In addition, the unwinder chucking part (130) chucks the replacement pouch roll (120) seated on the transport part (150), and upon chucking, the central axis height of the replacement pouch roll (120) seated on the transport part (150) must be the same as the chucking height of the unwinder chucking part (130). At this time, the central axis height of the replacement pouch roll (120) may be a height (z-axis direction in FIG. 1) based on the bottom surface of the installation space where the transport part (150) is installed.

If the roll diameter is different for each newly supplied replacement pouch roll (120), the central axis height of the replacement pouch roll (120) seated on the transport part (150) varies. At this instance, since the unwinder chucking part (130) has a fixed chucking height, the central axis height of the replacement pouch roll (120) must be adjusted to be the same as the chucking height of the unwinder chucking part (130) before being chucked.

In addition, before the replacement pouch roll (120) is transported to the unwinder chucking part (130), the replacement chucking part (140) is provided to chuck the replacement pouch roll (120). At this time, the replacement chucking part (140) has a predetermined chucking height, where the chucking height may be a height based on the bottom surface of the installation space on which the chucking part (140) is installed.

The replacement chucking part (140) chucks the replacement pouch roll (120) seated on the transport part (150), and upon chucking, the central axis height of the replacement pouch roll (120) seated on the transport part (150) must be the same as the chucking height of the replacement chucking part (140). As described above, the central axis height of the replacement pouch roll (120) may be a height based on the bottom surface of the installation space where the transport part (150) is installed.

If the roll diameter is different for each replacement pouch roll (120) newly supplied in the battery manufacturing process, the central axis height of the replacement pouch roll (120) seated on the transport part (150) varies. At this time, since the replacement chucking part (140) has a fixed chucking height, the central axis height of the replacement pouch roll (120) must be adjusted to be the same as the chucking height of the replacement chucking part (140) before being chucked.

Referring to FIG. 1, when a replacement pouch (120) is chucked to the replacement chucking part (140), the work of connecting the end of the pouch (125) wound around the replacement pouch roll (120) and the end of the pouch (115) being supplied to the battery manufacturing process is performed.

FIG. 3 schematically illustrates a configuration diagram of a pouch roll replacement system according to one example of the present invention, and FIG. 4 is a diagram for explaining a process for correcting a height of a replacement pouch roll in one example of the present invention.

The pouch roll replacement system (100) related to one example of the present invention may automatically correct the height (h1) of the replacement pouch roll (120) so that the central axis height of the replacement pouch roll (120) matches the chucking height of the replacement chucking part (140) and the central axis height of the traveling pouch roll (110) chucked to the unwinder chucking part (130).

Also, in this document, the chucking height of the replacement chucking part (140) may be provided to be the same as the chucking height (h0) of the unwinder chucking part (130). That is, the unwinder chucking part (130) may have the same chucking height as that of the replacement chucking part (140), and the transport part (150) may be provided to transport the replacement pouch roll (120) from the replacement chucking part (140) to the unwinder chucking part (130).

In addition, in this document, the traveling pouch roll (110) and the replacement pouch roll (120) may be aluminum (AL) pouch rolls used in a packaging (PKG) process.

The pouch roll replacement system (100) according to one example of the present invention comprises a transport part (150) transporting a replacement pouch roll (120) and capable of adjusting the central axis height (h1) of the replacement pouch roll (120), and a replacement chucking part (140) provided to chuck the replacement pouch roll (120) transported through the transport part (150) and having a predetermined chucking height.

Also, the pouch roll replacement system (100) comprises an unwinder chucking part (130) with a traveling pouch roll (110) installed, a measuring part (160) measuring the distance to the replacement pouch roll (120) seated on the transport part (150) before transporting the replacement pouch roll (120) to the replacement chucking part (140), and a control part (190) controlling the transport part (150) so that the central axis height (h1) of the replacement pouch roll (120) seated on the transport part (150) is adjusted based on the measurement information of the measuring part (160) and the chucking height of the replacement chucking part (140).

In addition, the pouch roll replacement system (100) may further comprise a pouch connection part (180) gripping the end of the pouch wound around the replacement pouch roll (120) chucked to the replacement chucking part (140), and then transferring the end of the pouch toward the unwinder chucking part (130).

Furthermore, when the end of the pouch is gripped through the pouch connection part (180), the control part (190) may chuck-release the replacement pouch roll (120) from the replacement chucking part (140), and then transport the replacement pouch (120) to the unwinder chucking part (130) through the transport part (150).

Also, the pouch roll replacement system (100) may further comprise a roll core recovery part (170) recovering the roll core of the traveling pouch roll (110) chuck-released from the unwinder chucking part (130).

The control part (190) controls the operation of the unwinder chucking part (130), the replacement chucking part (140), the measuring part (160), and the pouch connection part (180).

Also, the control part (190) may control the operation of the transport part (150) so that the central axis height of the replacement pouch roll (120) seated on the transport part (150) is adjusted, and then the replacement pouch roll (120) is transported to the replacement chucking part (140).

In addition, the control part (190) may be provided so that it calculates the diameter of the replacement pouch roll (120) based on the measurement information of the measuring part, and, calculates the difference between the chucking height of the replacement chucking part (140) and the central axis height of the replacement pouch roll (120) seated on the transport part (150) based on the diameter of the replacement pouch roll (120).

Furthermore, the control part (190) may calculate the difference between the chucking height of the replacement chucking part (140) and the central axis height of the replacement pouch roll seated on the transport part (150) as a height correction value, and may control the transport part (150) so that the central axis height of the replacement pouch roll (120) seated on the transport part (150) is adjusted by the height correction value.

Also, the control part (190) may adjust the central axis height of the replacement pouch roll (120) seated on the transport part so that the central axis height of the replacement pouch roll (120) seated on the transport part (150) matches the chucking height of the replacement chucking part.

In addition, the measuring part (160) may comprise a distance sensor measuring the distance from the replacement pouch roll (120) seated on the transport part (150), and the distance sensor may be an ultrasonic sensor.

Referring to FIG. 4, the measuring part (160) may be provided to measure the distance from the replacement pouch roll (120) seated on the transport part (150) before the replacement pouch roll (120) is transported to the replacement chucking part (140).

Also, the measuring part (160) is provided to measure the distance from the replacement pouch roll (120) at the reference position of the transport part (150) (also referred to as the 'transport standby position'). At this time, distance information according to the diameter of the replacement pouch roll (120) may be stored in advance in the control part (190), and as the measuring part (160) measures the distance from the replacement pouch roll (120), and the control part (190) compares the measured distance with the pre-stored distance information, it is possible to calculate the diameter of the replacement pouch roll (120).

In addition, the control part (190) may calculate the central axis height (h1) of the replacement pouch roll (120) seated on the transport part (150) based on the height information of the transport part (150) and the diameter information of the replacement pouch roll (120) at the reference position.

Furthermore, in the control part (190), the chucking heights of the replacement chucking part (140) and the unwinder chucking part (130) are each stored, and the control part (190) adjusts the central axis height of the replacement pouch roll (120) seated on the transport part (150) so that the central axis height of the replacement pouch roll (120) seated on the transport part (150) matches the chucking height of the replacement chucking part.

FIGS. 5 to 7 are diagrams for explaining operating states of a transport part (150) in a pouch roll replacement system according to one example of the present invention.

The pouch roll replacement system (100) according to one example of the present invention comprises an unwinder chucking part (130), a replacement chucking part (140), a transport part (150), a measuring part (160), and a roll core recovery part (170), a pouch connection part (180), and a control part (190).

The unwinder chucking part (130) is provided in an unwinder of a secondary battery manufacturing process. The traveling pouch roll (110) is rotatably installed in the unwinder chucking part (130) so that the pouch (115) wound around the traveling pouch roll (110) can be unwound.

Also, the replacement chucking part (140) is a device in which the replacement pouch roll (120) is chucked. In this example, the replacement pouch roll (120) is sequentially transported to the replacement chucking part (140) and the unwinder chucking part (130) through the transport part (150).

In addition, the replacement chucking part (140) may have the same chucking height as the chucking height of the unwinder chucking part (130) in the transport path (M, x-axis direction) of the transport part (150), and may be disposed in line with the unwinder chucking part (130).

The transport part (150) sequentially transports the replacement pouch roll (120) to the replacement chucking part (140) and the unwinder chucking part (130). The transport part (150) comprises a transport rail (151), a shuttle (153), and a height adjustment unit (155).

Specifically, the transport part (150) may comprise a transport rail (151) extending to guide the transport of the replacement pouch roll (120) through the replacement chucking part (140) to the unwinder chucking part (130), a shuttle (153) including a seating member (154), on which the replacement pouch roll (120) is seated, and provided to be movable along the transport rail (151), and a height adjustment unit (155) adjusting the height of the seating member (154).

In addition, the transport rail (151) forms a transport path (x-axis direction) that guides transport of the replacement pouch roll (120) to the unwinder chucking part (130). The shuttle (153) is installed on the transport rail (151) to be capable of reciprocating.

The shuttle (153) is installed to be capable of reciprocating along the transport rail (151) back and forth. When the traveling pouch roll (110) is replaced with the replacement pouch roll (120), the shuttle (153) is moved at the transport standby position (P0) of the transport part (150) to the unwinder chucking part (130).

Then, when the replacement pouch roll (120) is chucked to the unwinder chucking part (130), the shuttle (153) is operated to return to the transport standby position (P0) from the unwinder chucking part (130).

The shuttle (153) is provided with the seating member (154). The replacement pouch roll (120) is seated on the seating member (154). The seating member (154) may have a shape curved with a predetermined curvature in order to stably support the replacement pouch roll (120), and for example, the seating member (154) may have an arc-shaped cross section.

In addition, the height adjustment unit (155) is coupled to the seating member (154). The height adjustment unit (155) is installed on the shuttle (153) to perform a function of adjusting the height of the seating member (154). The height adjustment unit (155) may comprise a servo motor.

The operation of the height adjustment unit (155) is controlled by the control part (190). The height adjustment unit (155) may adjust the central axis height of the replacement pouch roll (120) along the height direction (z-axis direction shown in FIG. 1) by the height correction value ($\Delta h$) calculated by the control part (190).

In addition, the measuring part (160) measures the distance to the replacement pouch roll (120) at the transport standby position (P0). The measuring part (160) comprises a distance sensor measuring the vertical distance from the replacement pouch roll (120) seated on the transport part (150) at the transport standby position (P0). An ultrasonic sensor may be used as the distance sensor.

In this example, the transport standby position (P0) is a position where the transport part (150) is during standby in a state where the measuring part (160) is installed and the replacement pouch roll (120) is seated, which may be a fixed position.

Also, at the transport standby position (P0), the transport part (150) may be located at the bottom of the measuring part (160).

In addition, the control part (190) may control the operation of the transport part (150) so that the central axis height of the replacement pouch roll (120) matches the central axis height of the traveling pouch roll (110) chucked on the unwinder chucking part (130) based on the measurement information of the measuring part (160).

As described above, the central axis height (also referred to as the 'chucking height') of the traveling pouch roll (110) may be preset in the control part (190) as the reference height ($h_0$). The control part (190) may receive the measured distance information to calculate the diameter of the replacement pouch roll (120), which calculates the central axis height ($h_1$) of the replacement pouch roll (120) based on the diameter information of the replacement pouch roll (120).

Referring to FIG. 4, the control part (190) may calculate a height correction value ($\Delta h$) which is the difference between the chucking height ($h_0$) and the central axis height ($h_1$) of the replacement pouch roll (120). Then, the control part (190) controls the operation of the transport part (150) so that the central axis height of the replacement pouch roll (120) is corrected by the height correction value ($\Delta h$).

In addition, the pouch connection part (180) may comprise a guide bar (181) extending from the upper part of the replacement chucking part (140) to the upper part of the unwinder chucking part (130), and a gripper (183) installed to be movable along the guide bar (181) and holding the end of the pouch (125) wound around the replacement pouch roll (120) to move from the replacement chucking part (140) toward the unwinder chucking part (130).

The guide bar (181) is installed parallel to the transport path (M) of the transport part (150) at the upper part of the unwinder chucking part (130) and the replacement chucking part (140). The gripper (183) is installed on the guide bar (181) to be capable of reciprocating back and forth.

The gripper (183) holds the end of the pouch (125) wound around the replacement pouch roll (120) to move forward from the replacement chucking part (140) toward the unwinder chucking part (130).

In addition, the roll core recovery part (170) is installed adjacent to the unwinder chucking part (130) in the transport path of the transport part (150). The roll core recovery part (170) recovers the roll core (111) of the traveling pouch roll (110) chuck-released from the chucking in the unwinder chucking part (130).

The roll core recovery part (170) may comprise a roll core guide member (171) and a roll core recovery container (173). The roll core guide member (171) may be connected to the unwinder chucking part (130), and the roll core guide member (171) may be installed parallel to the transport rail (151). The roll core (111) of the traveling pouch roll (110) chuck-released from the unwinder chucking part (130) is recovered into the roll core recovery container (173) along the roll core guide member (171).

FIGS. 5 to 8 are diagrams for explaining operating states of a transport part in a pouch roll replacement system according to one example of the present invention.

Hereinafter, referring to FIGS. 5 to 8, a pouch roll position correction method using the pouch roll replacement system (100) will be described.

In the control part (190), the central axis height of the traveling pouch roll (110) chucked in the unwinder chucking part (130) is preset to the reference height ($h_0$). Here, the chucking height of the unwinder chucking part (130) is a fixed height, and the chucking height of the unwinder chucking part (130) is the same as the chucking height of the replacement chucking part (140). The chucking height of the unwinder chucking part (130) corresponds to the central axis height of the traveling pouch roll (110).

Referring to FIG. 5, the replacement pouch roll (120) is supplied to the transport part (150). The transport part (150) is located at the transport standby position (P0). At the transport standby position, the replacement pouch roll (120) is in a state of being seated on the seating member (154).

Referring to FIG. 6, at the transport standby position, the central axis height of the replacement pouch roll (120) is measured as the measurement height ($h_1$). The measuring part (160) measures the distance to the replacement pouch roll (120) at the transport standby position (P0). At the transport standby position (P0), the measuring part (160) and the transport part (150) are disposed up and down.

At this time, the control part (190) calculates the central axis height of the replacement pouch roll (120) as the measurement height ($h_1$), based on the measurement information.

Subsequently, the control part (190) may calculate a height correction value ($\Delta h$) of the replacement pouch roll (120) with respect to the traveling pouch roll (110). The height correction value ($\Delta h$) is the difference value between the reference height ($h_0$) and the measurement height ($h_1$).

In addition, the control part (190) controls the operation of the transport part (150) so that the central axis height of the replacement pouch roll (120) matches the reference height ($h_0$) based on the height correction value ($\Delta h$) information. At this instance, the height adjustment unit (155) adjusts the central axis height of the replacement pouch roll (120) by the height correction value ($\Delta h$). Through this process, the central axis height of the replacement pouch roll (120) seated on the transport part (150) is matched to the reference height ($h_0$).

Referring to FIG. 7, the replacement pouch roll (120) is transported at the transport standby position (P0) to the replacement chucking part (140) by the transport part (150). The replacement pouch roll (120) is chucked to the replacement chucking part (140) in a state of being seated on the transport part (150).

Upon replacement of the traveling pouch roll (110), the replacement pouch roll (120) chucked to the replacement chucking part (140) is chuck-released, and the replacement pouch roll (120) is separated from the replacement chucking part (140). The replacement pouch roll (120) separated from the replacement chucking part (140) is transported to the unwinder chucking part (130) by the transport part (150).

In addition, upon replacement of the traveling pouch roll (110), the unwinder chucking part (130) is operated to chuck-release the traveling pouch roll (110). The used traveling pouch roll (110) is recovered from the unwinder chucking part (130) to the roll core recovery part (170).

Referring to FIG. 8, when the replacement pouch roll (120) is chucked to the unwinder chucking part (130), the transport part (150) is operated to return from the unwinder chucking part (130) to the transport standby position (P0).

One example of the present invention as described above has been disclosed for illustrative purposes, and those skilled in the art having ordinary knowledge of the present invention will be able to make various modifications, changes, and additions within the spirit and scope of the present invention, and such modifications, changes, and additions should be regarded as falling within the scope of the following claims.

INDUSTRIAL APPLICABILITY

According to the pouch roll replacement system according to one example of the present invention, and the pouch roll position correction method using the same, by measuring the roll diameter of the replacement pouch roll seated on the transport part before transporting the replacement pouch to the replacement chucking part, it is possible to adjust the central axis height of the replacement pouch roll seated on the transport part to the chucking heights of the replacement chucking part and the unwinder chucking part.

The invention claimed is:

1. A pouch roll replacement system comprising:

a transport part configured to transport a replacement pouch roll and adjust a central axis height of the replacement pouch roll;

a replacement chucking part configured to chuck and unchuck the replacement pouch roll and having a predetermined chucking height;

a pouch connection part having a gripper configured to grip an end of the replacement pouch roll while the replacement pouch roll is chucked to the replacement chucking part, the pouch connection part being configured to transfer the end of the replacement pouch roll gripped by the gripper towards the unwinder chucking part;

an unwinder chucking part configured to accommodate the replacement pouch roll after the replacement roll is unchucked from the replacement chucking part;

a measuring part configured to measure a distance to the replacement pouch roll disposed on the transport part before the replacement pouch roll is transported to the replacement chucking part to obtain a measurement information; and a control part configured to control the transport part so that the central axis height of the replacement pouch roll disposed on the transport part is adjusted based on the measurement information and the predetermined chucking height of the replacement chucking part, wherein the transport part is configured to transport the replacement pouch roll from the replacement chucking part to the unwinder chucking part while the end of the replacement pouch roll is gripped by the gripper.

2. The pouch roll replacement system according to claim 1, wherein the control part is configured to control an operation of the transport part so that the replacement pouch roll is transported to the replacement chucking part after the central axis height of the replacement pouch roll disposed on the transport part is adjusted.

3. The pouch roll replacement system according to claim 1, wherein the control part is configured to calculate a diameter of the replacement pouch roll based on the measurement information, and to calculates a difference between the predetermined chucking height of the replacement chucking part and the center axis height of the replacement pouch roll disposed on the transport part based on the diameter of the replacement pouch roll.

4. The pouch roll replacement system according to claim 3, wherein the difference between the predetermined chucking height of the replacement chucking part and the central axis height of the replacement pouch roll disposed on the transport part is a height correction value, and wherein the control part is configured to control the transport part so that the central axis height of the replacement pouch roll disposed on the transport part is adjusted by the height correction value.

5. The pouch roll replacement system according to claim 3, wherein the control part is configured to adjust the central axis height of the replacement pouch roll seated on the transport part to match the predetermined chucking height of the replacement chucking part.

6. The pouch roll replacement system according to claim 1, wherein the unwinder chucking part has a chucking height that is the same as the predetermined chucking height of the replacement chucking part.

7. The pouch roll replacement system according to claim 6, wherein the transport part comprises:

a transport rail extending toward the unwinder chucking part;

a shuttle including a seating member configured to accommodate the replacement pouch roll, and provided to be movable along the transport rail; and a height adjustment unit configured to adjust a height of the seating member, wherein the transport rail guides the shuttle through the replacement chucking part to the unwinder chucking part.

8. The pouch roll replacement system according to claim 7, wherein the shuttle is provided to be capable of a reciprocating movement along the transport rail, wherein the shuttle is configured to move toward the unwinder chucking part when the replacement pouch roll is placed, and wherein the shuttle is configured to move along the transport rail from the unwinder chucking part to the measuring part after the replacement pouch roll is chucked to the unwinder chucking part.

9. The pouch roll replacement system according to claim 7, wherein the seating member has a predetermined curvature.

10. The pouch roll replacement system according to claim 1, wherein the measuring part comprises a distance sensor configured to measure the distance from the replacement pouch roll accommodated on the transport part.

11. The pouch roll replacement system according to claim 10, wherein the distance sensor is an ultrasonic sensor.

12. The pouch roll replacement system according to claim 1, wherein the pouch connection part further comprises:

a guide bar extending from an upper part of the replacement chucking part to an upper part of the unwinder chucking part, and wherein the gripper is configured to be movable along the guide bar.

13. The pouch roll replacement system according to claim 12, wherein the control part is configured to chuck-release the replacement pouch roll from the replacement chucking part after the gripper attaches to the end of the replacement roll pouch, and is configured to control the transport part to then transport the replacement pouch roll to the unwinder chucking part.

14. The pouch roll replacement system according to claim 1, further comprising a roll core recovery part configured to recover a roll core of the traveling pouch roll from the unwinder chucking part.

15. The pouch roll replacement system according to claim 1, wherein the gripper is configured to supply the end of the replacement pouch to a battery manufacturing assembly at the second location.

16. The pouch roll replacement system according to claim 1, wherein the replacement chucking part is configured to partially unwind the replacement pouch roll.

17. The pouch roll replacement system according to claim 16, wherein the replacement chucking part is configured to be partially unwound as to engage the end of the replacement chucking part with the gripper at a guide bar.

18. The pouch roll replacement system according to claim 1, wherein the pouch connection part is configured to translate the end of the replacement pouch roll gripped by the gripper from a first location to a second location.

19. The pouch roll replacement system according to claim 18, wherein the second location is adjacent to the unwinder chucking part.

20. The pouch roll replacement system according to claim 18, wherein the first location is adjacent to the replacement chucking part.

* * * * *